United States Patent [19]

Bristol

[11] 4,401,068

[45] Aug. 30, 1983

[54] APPARATUS FOR SPLIT ENGINE OPERATION

[76] Inventor: Robert D. Bristol, P.O. Box 337, Beulah, Mich. 49617

[21] Appl. No.: 199,818

[22] Filed: Oct. 23, 1980

[51] Int. Cl.[3] ..... F02D 9/00; F02M 13/04

[52] U.S. Cl. ..... 123/198 F; 261/23 A

[58] Field of Search ..... 123/198 F, DIG. 6, DIG. 7; 261/23 A

[56] References Cited

U.S. PATENT DOCUMENTS

| | | | |
|---|---|---|---|
| 587,102 | 7/1897 | Meany | 138/93 |
| 1,838,656 | 12/1931 | Bullock | 138/94.3 |
| 1,922,003 | 8/1933 | Shuman | 137/76 |
| 2,878,798 | 3/1959 | Dolza et al. | 123/198 F |
| 2,884,222 | 4/1959 | Oakes | 251/73 |
| 3,774,678 | 11/1973 | Glorisi | 165/76 |
| 4,019,479 | 4/1977 | Garabedian | 123/198 F |
| 4,064,844 | 12/1977 | Matsumoto et al. | 123/198 F |
| 4,064,861 | 12/1977 | Schulz | 123/198 F |
| 4,080,948 | 3/1978 | Dolza, Sr. | 123/198 F |
| 4,135,484 | 1/1979 | Malott | 123/198 F |
| 4,146,006 | 3/1979 | Garabedian | 123/198 F |
| 4,215,845 | 8/1980 | Sturgeon | 123/198 F |

OTHER PUBLICATIONS

Article from The Grand Rapids Press, entitled "Cadillac Shows Off First 'V-8-6-4' Engine".

*Primary Examiner*—Ira S. Lazarus

*Attorney, Agent, or Firm*—Price, Heneveld, Huizenga & Cooper

[57] ABSTRACT

An apparatus positionable between a multi-barrel carburetor and an intake manifold of an internal combustion engine includes a plurality of stacked, thin plates defining aligned apertures communicating the carburetor with the intake manifold. One of the plates defines a valve element aperture within which a movable valve element is disposed. The valve element is shiftable to block one of the aligned apertures to disable selected cylinders of the engine, thereby achieving split engine operation.

21 Claims, 15 Drawing Figures

APPARATUS FOR SPLIT ENGINE OPERATION

BACKGROUND OF THE INVENTION

The present invention relates to internal combustion engines and more particularly to apparatus for disabling selected cylinders of a multi-cylinder engine to achieve split engine operation.

Heretofore, various proposals have been made for operating an internal combustion engine on less than all of its complement of cylinders. Such operation is typically referred to as split engine operation. Under low and moderate load conditions, the efficiency and hence the rate of fuel consumption of an engine may be improved by reducing the number of operating cylinders. With an eight-cylinder engine, for example, once cruising speed is obtained, four cylinders are sufficient to maintain the cruise speed. Internal combustion engines operate most efficiently when they are under a load. By disabling selected cylinders, the remaining active cylinders are placed under a slightly increased load and therefore operate more efficiently. Overall fuel economy is increased.

Examples of prior apparatus for achieving split engine operation may be found in U.S. Pat. No. 2,878,798, entitled SPLIT ENGINE and issued on Mar. 24, 1959, to Dolza et al; U.S. Pat. No. 4,064,844, entitled APPARATUS AND METHOD FOR SUCCESSIVELY INACTIVATING THE CYLINDERS OF AN ELECTRONICALLY FUEL-INJECTED INTERNAL COMBUSTION ENGINE IN RESPONSE TO SENSED ENGINE LOAD and issued on Dec. 27, 1977, to Matsumoto et al; U.S. Pat. No. 4,064,861, entitled DUAL DISPLACEMENT ENGINE and issued on Dec. 27, 1977, to Schulz; and U.S. Pat. No. 4,080,948, entitled SPLIT ENGINE CONTROL SYSTEM and issued on Mar. 28, 1978, to Dolza, Sr.

Some of the prior devices are relatively complicated, must be incorporated into the original engine design or may not be added to existing engines without significant reworking and redesign of engine components. Other devices, such as those represented by the Schulz patent and the Dolza, Sr. patent noted above, may be added with little or no modification to the engine. The Schulz patent discloses a system including an auxiliary throttle assembly, an exhaust valve lock-up assembly and a micro-switch cam control assembly. The auxiliary throttle assembly is located in a modified passageway of the fuel intake manifold. A flexible cable connects a butterfly valve plate to the exhaust valve lock-up mechanism. Linkage also interconnects the butterfly valve with the micro-switch cam control. In operation, selective cylinders of the engine are disabled by moving the butterfly valve to a closed condition, thereby cutting off the air/fuel mixture to a particular cylinder. The exhaust valve for that same cylinder is held in an open position upon closure of the butterfly valve.

The control system disclosed in the Dolza, Sr. patent includes a shuttle valve structure positionable between the base of the engine carburetor and the partitioned inlet passages of an intake manifold. The shuttle valve is slidably disposed in a piston-like chamber. Intake manifold pressure or vacuum within the manifold passages leading to the "active" cylinders is sensed and used to control positioning of the shuttle valve.

A still further system which has recently been commercialized permits an eight-cylinder engine to run on eight, six or four cylinders, depending upon the load and power demand. This system employs a solenoid mechanism which disables the valves on the "inactive" cylinder so that the valves remain in a closed position.

A need exists for a relatively simple and easily manufactured device for achieving split engine operation and which is readily usable and incorporated into existing engines with minimal, if any, modification.

SUMMARY OF THE INVENTION

In accordance with the present invention, a manually actuable apparatus is provided which fulfills the aforementioned need. Essentially, the device includes a plurality of stacked plates and a multi-positionable plate-like valve element. The stacked plates define apertures alignable with the barrels of the carburetor. The device is positionable between the base of the carburetor and the top of the intake manifold. The valve element is shiftable between first and second positions. When in a first position, the valve element blocks one of the barrels of the carburetor, thereby shutting off the air/fuel mixture to selected cylinders. When moved to the second position, free communication is permitted between the carburetor and the intake manifold.

The device is compact and has an extremely thin profile. The plates may be punched or stamped sheet metal members and, due to their configuration, tolerances are not overly critical. A simple cable actuator is connectable to the valve element so that the valve element may be shifted between its positions from the passenger compartment. In one embodiment in accordance with the present invention, a valve plate is shiftable along a longitudinal axis between the first and second positions. In a second embodiment, a generally circular valve element defining a plurality of apertures therein is rotatably shiftable to selectively disable one bank of cylinders in a multi-cylinder engine.

The device in accordance with the present invention is easily and relatively inexpensively manufactured. The device is readily assembled and installed in an internal combustion engine without modification of the engine. The device is merely inserted or sandwiched between the base of the carburetor and the inlet of the intake manifold. The advantages and efficiency of split engine operation are, therefore, readily and easily achieved with existing multi-cylinder engines.

DETAILED DESCRIPTION OF THE PREFERRED EMBODIMENT

Figure 1:
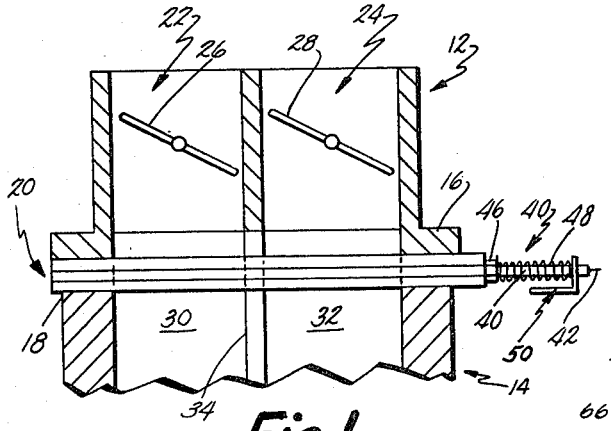
FIG. 1 is a schematic, cross-sectional view showing a device in accordance with the present invention positioned between a carburetor and an intake manifold of an internal combustion engine.

FIG. 1 schematically illustrates a portion of an internal combustion engine including a multi-barrel carburetor generally designated 12 and an intake manifold generally designated 14. A device 20 in accordance with the present invention is mounted between a base 16 of the carburetor and an inlet end 18 of the intake manifold. The multi-barrel carburetor 12 includes a pair of barrels or bores 22, 24. Butterfly throttle valves 26, 28 are rotatably positioned within the respective bores. The throttle valves are positioned through conventional linkage (not shown) connected to an accelerator pedal within the operator compartment. The basic configuration of the carburetor, the fuel feed mechanism and the linkage are well-known to those of ordinary skill in the art and are not described in detail herein.

The intake manifold 14 defines a first passage 30 and a second passage 32. The passages are separated by a partition wall 34. In conventional intake manifolds, passage 30 would lead to half of the cylinders of the multi-cylinder engine, and passage 32 would lead to the remaining half of the cylinders. The air/fuel mixture is metered to the cylinders through barrels 22, 24 of the carburetor structure.

In conventional four-barrel carburetors, a primary barrel and a secondary barrel would feed to passage 30 and another primary barrel and secondary barrel would feed to passage 32. During normal operation, an air/fuel mixture is metered to the cylinders through the primary barrels. Under rapid acceleration conditions, the secondary barrels would "kick in" to feed additional air/fuel mixture to the passages 30, 32. In conventional two-barrel systems, only barrels 22, 24 would be provided or defined by the carburetor structure.

Device 20 in accordance with the present invention is adapted to block communication between barrel 24 and intake manifold passage 32 so that more efficient operation may be achieved during light and moderate load conditions.

A cable actuator generally designated 40 in FIG. 1 is connected to device 20, as explained in more detail below. The cable actuator includes a flexible cable 42 disposed within a cable housing or outer sheath 44. The cable is lead through the fire wall of the vehicle to the operator compartment. A free end 46 of the cable 42 is connected to device 20. A coil spring 48 engages a bracket 50 at one end and a shiftable valve element of the device at the other end. As will become apparent, the cable will shift the device between first and second positions to block communication between bore 24 and passage 32 and to permit free communication of the air/fuel mixture between these portions of the charge forming system of the vehicle.

Figure 2:
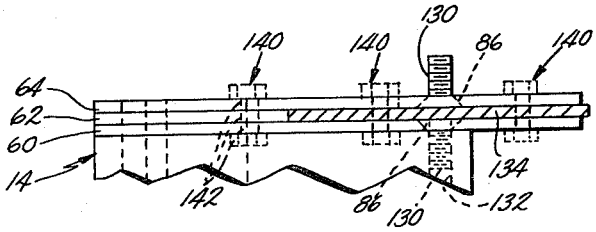
FIG. 2 is a side, elevational view of the device in accordance with the present invention.

FIGS. 2–6 illustrate a device 20 in accordance with the present invention which is adapted for use with a four-barrel carburetor and which will selectively block off a primary and secondary barrel of the carburetor to prevent passage of an air/fuel mixture to one passage means of the intake manifold to thereby achieve split engine operation. As seen in FIG. 2, the device includes three stacked or superimposed plates, namely, a base plate 60, an intermediate plate 62 and a top plate 64. Intermediate plate 62 is sandwiched between plates 60 and 64.

Figure 3:
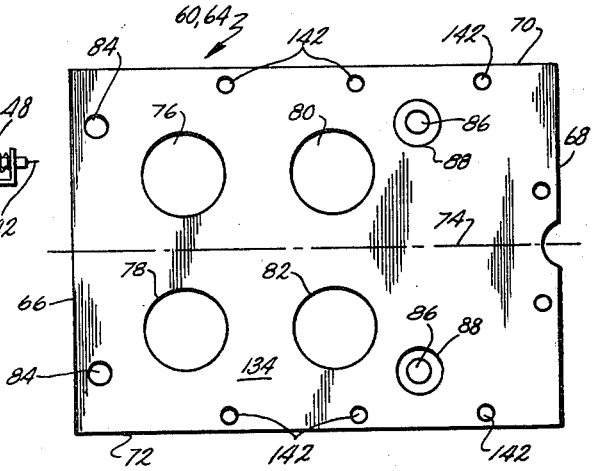
FIG. 3 is a top, plan view of a base or top plate.

Plates 60 and 64 are identical in configuration and are illustrated in FIG. 3. As shown therein, the base and top plates have a generally rectangular configuration and include a front edge 66, a trailing edge 68 and lateral edges 70, 72. The plates are symmetrical about a longitudinal axis 74. The plates each define a forward pair of barrel apertures 76, 78 and a rearward pair of barrel apertures 80, 82. The apertures 76, 78 and 80, 82 are positioned to be coaxially aligned with a respective pair of primary and secondary barrels of a four-barrel carburetor. The plates also define two pairs of mounting apertures, namely, a forward, transversely spaced pair of apertures 84 and a rearward, transversely spaced pair of mounting apertures 86. As seen in FIGS. 2 and 3, apertures 86 are countersunk or chamfered and each defines a bevel surface 88.

Figure 4:
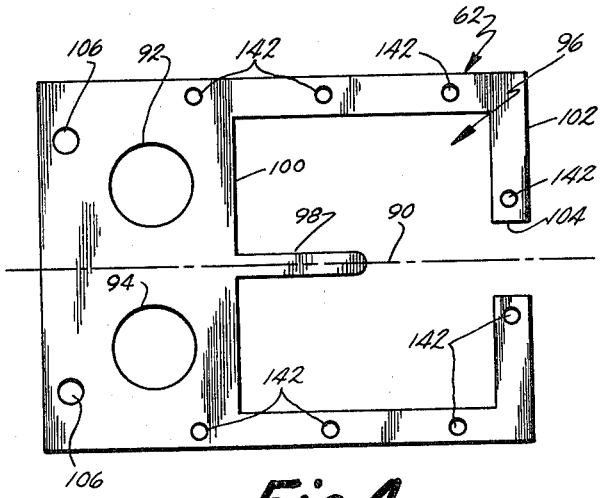
FIG. 4 is a top, plan view of an intermediate plate.

Intermediate plate 62 is illustrated in FIG. 4. As shown therein, plate 62 is also an elongated, flat member having a longitudinal axis 90. Plate 62 is symmetrical about longitudinal axis 90 and defines a forward, transversely spaced pair of apertures 92, 94. Plate 62 also defines an elongated valve element receiving aperture 96. Aperture 96 is generally rectangular in configuration. Plate 62 defines a guide portion 98 which extends from a forward edge 100 of aperture 96 towards a rear edge 102 of plate 62. Plate 62 further defines an opening 104 between rear edge 102 and aperture 96. Plate 62 also defines forward mounting holes or apertures 106.

Figure 5:
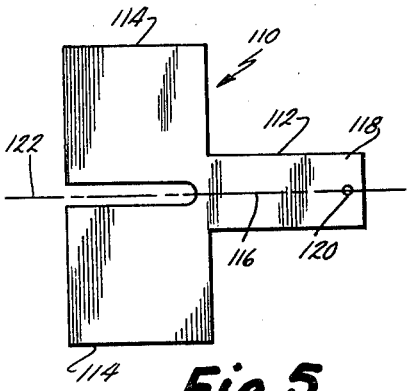
FIG. 5 is a top, plan view of a slide element.

Plate 62 is adapted to receive and guide a valve element 110 illustrated in FIG. 5. Valve element 110 has a generally "Y" configuration in plan including an elongated base leg 112 and a pair of arms 114. Valve element 110 is symmetrical about its longitudinal axis 116. Leg 112 at its free end 118 includes a cable mounting aperture 120. Free end 46 of cable 42 is secured to the valve element 110 at aperture 120. Arm portions 114 of valve 110 are separated by an elongated guide slot 122.

The plates and valve element may be stamped or punched from sheet metal including sheet steel and aluminum. The plates and valve element could also be cast and machined or possibly molded from fuel resistant plastic materials. It is believed, however, that a punch operation would be the most cost effective.

Figure 6:
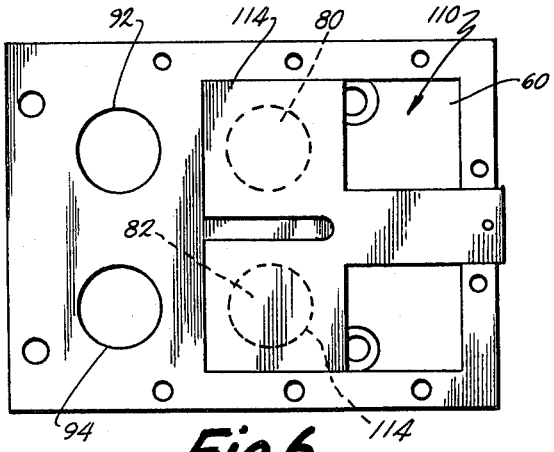
FIG. 6 is a top, plan view showing the intermediate plate stacked on the base plate with the slide valve in position.

Assembly of the device is illustrated in FIGS. 2 and 6. Base plate 60 would first be positioned on the intake manifold. Flathead fasteners 130 are disposed in apertures 86. Plate 60 is positioned so that the beveled surface 88 tapers inwardly towards a threaded mounting bore 132 defined by the conventional intake manifold. Flathead fasteners 130 when threaded into bore 132 will be flush with a top surface 134 of plate 60. Next, intermediate plate 62 would be placed on top of plate 60. Aperture 92 would be aligned with aperture 76, and aperture 94 would be aligned with aperture 78. Mounting apertures 106 on plate 62 are aligned with mounting apertures 84 on plate 60. Next, valve element 110 is placed on base plate 60 within the confines of aperture 96. Top plate 64 is then secured to the base of the carburetor with flathead fasteners 130 passing through apertures 86 of the top plate. The top plate is rotated through an angle of 180° around longitudinal axis 74 when compared with base plate 60 that the apertures 86 taper upwardly towards the carburetor. As a result, flathead fasteners 130 will be flush with surface 134 of plate 64. Next, the carburetor with the plate 64 attached thereto would be placed upon intermediate plate 62 and positioned so that mounting apertures 84, 106 align and that the paired apertures 76, 78, 80, 82 and 92, 94 are in coaxial alignment. With certain carburetor constructions, the throttle valve pivots below the base thereof. In order to provide sufficient clearance, additional top plates may have to be added. The plates are then secured together by suitable fasteners 140 passing through securement apertures 142 defined by plates 60, 62 and 64. Carburetor mounting bolts are passed through the aligned forward mounting apertures 84 of plates 60, 64 and 106 of plate 62. Finally, free end 46 of cable 42 is secured to aperture 120 in valve element 110.

OPERATION

The operation of the device illustrated in FIGS. 2–6 should now be readily apparent to those of ordinary skill in the art. When in position between the base 16 of the carburetor and the inlet manifold 14, apertures 76, 78 of the top and base plates are aligned with apertures 92, 94 of the intermediate plate. As a result, one set of primary and secondary barrels of a four-barrel carburetor will communicate through the device with intake manifold passage 30. Similarly, apertures 80, 82 of the top and base plates will be aligned with the remaining set of primary and secondary barrels of the carburetor which communicate with intake manifold passage 32. Valve element 110 is positionable through cable actuator 40 to a first position illustrated in FIG. 6. As seen in FIG. 6, arms 114 of valve element 110 are positioned between apertures 80, 82 of the top and base plates. As a result, communication between the second set of primary and secondary barrels of the carburetor and intake manifold passage 32 is blocked. When cable 42 is pulled to the right, when viewed in FIG. 6, valve element 110 will shift to the far right until it abuts the rear edge of aperture 96. When in this position, free communication is permitted and apertures 80, 82 are open to intake manifold passage 32.

Guide portion 98 of intermediate plate 62 extends into guide slot 122 of the valve element. This guides the valve element 110 in its movement and prevents skewing or jamming of the element between the upper and lower plates. Valve element 110 is also guided by sliding contact between lateral edges of leg 112 and the opposed edges of the open slot 104 of the intermediate plate. The right angular configuration of the valve plate 110 and the configuration of aperture 96 and slot 104 in effect provide a labyrinth passageway so that an effective seal is maintained to prevent leakage of air into apertures 80, 82 of base plate 60 when all eight cylinders are operating.

The device includes only three basic elements which may be stamped or punched from sheet metal employing conventional manufacturing techniques. Each plate is approximately one-quarter of an inch thick. The device, therefore, has an extremely low profile and takes up very little space when installed.

Figure 7:
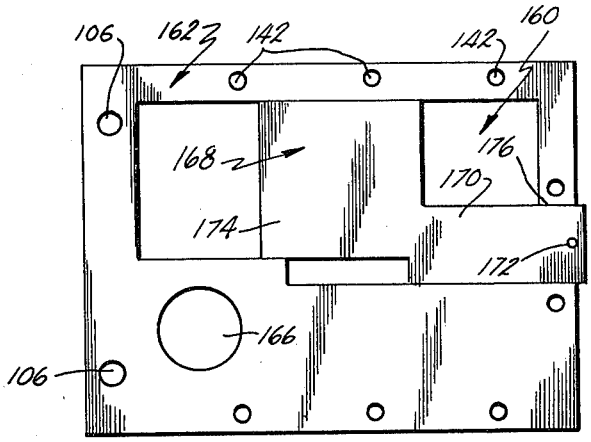
FIG. 7 is a top, plan view of an alternative embodiment in accordance with the present invention adapted for use with two-barrel carburetors.

In order to adapt the device in accordance with the present invention for use with a two-barrel carburetor, an alternative valve element and intermediate plate would be substituted for plate 62 and valve element 110 described above. The alternative intermediate plate is illustrated in FIG. 7 and generally designated 162. Plate 162 includes forward mounting apertures 106 and securement apertures 142. Apertures 106 and 104 are positioned to be alignable with the corresponding apertures on the top and base plates 60, 62. Elongated plate 162 defines an elongated valve element aperture 164 and a barrel aperture 166. Aperture 166 is positioned to permit communication of one barrel of the two-barrel carburetor through the device to one passage of the intake manifold structure.

Elongated aperture 164 is adapted to receive a generally L-shaped valve element 168. Valve element 168 includes an elongated leg 170 having a cable securement aperture 172 at a free end and a generally rectangular, enlarged blocking portion 174. When in position, leg 170 extends through a rearward slot 176 defined by plate 162. A forward area of aperture 164, as should be apparent, would be aligned with apertures 76 of the base and top plates. Aperture 166 would be aligned with aperture 78 of the base and top plates. When intermediate plate 162 and valve element 168 are sandwiched between the top and base plates, edges of the valve element 168 will contact edges of the aperture 164 and slot 176 so as to be guided thereby.

Valve element 168 is readily shiftable along a longitudinal axis of intermediate plate 162 between first and second positions. As illustrated in FIG. 7, the valve element is intermediate such first and second positions. When shifted to the extreme left of aperture 164, enlarged portion 174 would block communication of one of the barrels of a two-barrel carburetor through apertures 76 of the top and bottom plates. This results in disablement of one bank of cylinders of the multi-cylinder engine. When shifted to a second position to the right, when viewed in FIG. 7, free communication is permitted through the device to the intake manifold passage. The right angular configuration of the valve element and the sandwiched manner of assembly of the plates prevent or limit leakage of air through slot 176 or between the plates to the intake manifold. The valve element is guided by its contact with the edges of the aperture 164 and slot 176 so that it will not skew or jam during shifting movement along the longitudinal axis of the plates between the first and second positions.

A manufacturer need merely provide the intermediate plate and valve element illustrated in FIG. 7 to adapt top and base plates 60, 64 for use with a two-barrel carburetor. In the alternative, the manufacturer could produce top and base plates including only a pair of forward apertures 76, 78 and redimension intermediate plate 162 and valve element 168 to reduce the overall length of the device.

Figure 9:
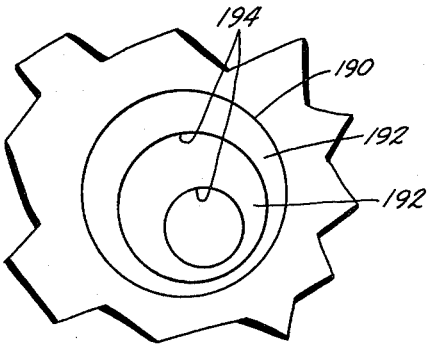
FIG. 9 is a fragmentary, plan view of an adjustable mounting means incorporated in the present invention.
Figure 8:
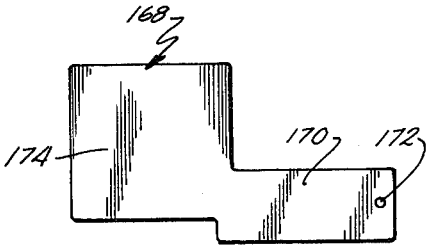
FIG. 8 is a top, plan view of the slide element incorporated in the embodiment of FIG. 7.

With either embodiment described above, an adjustable mounting means, illustrated in FIG. 9, could be used. As shown therein, each plate 60, 62, 64 and 162 could be formed with an enlarged mounting aperture 190. Positioned within aperture 190 are generally cylindrical or circular members 192, each having an eccentrically formed hole 194. Rotation of circular members 192 within aperture 190 will position holes 194 in a plurality of adjustable positions. This permits the plates to be adapted to different bolt patterns which can be encountered in existing internal combustion engines.

The mounting hole or aperture patterns for the plates may in effect become "universal" and the device would be usable with the majority of carburetor intake manifold patterns in existence without modification or the need to drill additional mounting holes.

Members 192 need merely be rotated at each of the mounting holes until fasteners 130 align with holes 194 and with the mounting bores in the carburetor and intake manifold.

The slide valve embodiments described above possess significant advantages over prior split engine operation devices. The components are readily punched from sheet metal. The devices have an extremely low profile when assembled resulting in minimal raising of the carburetor with respect to the intake manifold.

When either device is installed, the operator during low or moderate load conditions, such as when cruising on a freeway, need merely manually shift cable 42 to position the slide elements to block communication of a barrel of the carburetor with its respective passage in the intake manifold to readily achieve split engine operation. When additional power is needed, pulling on the cable shifts the valve element to its inoperative position permitting full multi-cylinder operation of the engine.

A device in accordance with the present invention has been tested on an eight-cylinder engine having a two-barrel carburetor. The device has consistently achieved an increase in fuel economy of between 10 and 15 percent under light and moderate load conditions. This is considered to be a significant increase in fuel economy.

The device is easily and relatively inexpensively manufactured and can be offered to the consumer at a reasonable and relatively low price. The installation procedure is simple and hence would not adversely add to the cost of incorporating the device in an existing engine. The benefits of increased fuel economy therefore become readily available.

ROTARY VALVE ELEMENT EMBODIMENT

Figure 10:
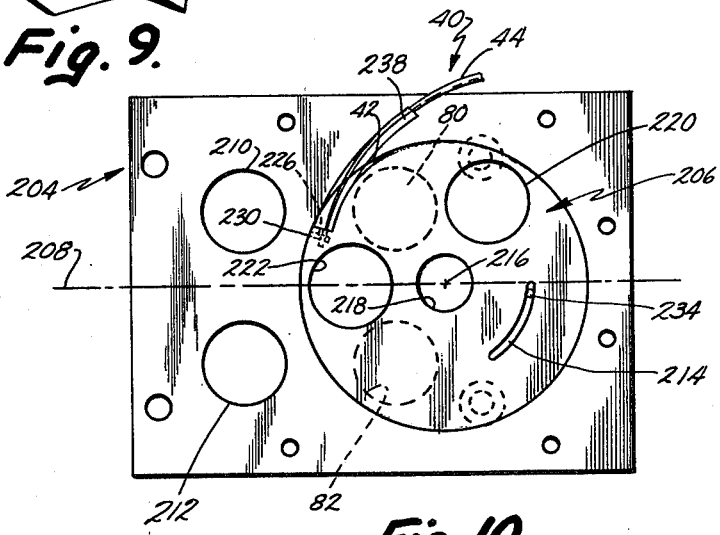
FIG. 10 is a side, elevational, fragmentary view of a further alternative embodiment employing a rotary, generally circular valve plate.

It has been found that with certain engine configurations, insufficient space is available rearwardly of the carburetor to permit full movement of slide valve elements 110, 168 without contacting other engine components, such as the distributor. When installed on such engines, modification must be made to the slide valve to permit it to move between its first and second positions and/or to permit ready hook up of the cable actuator 40. In order to overcome these installation problems, the embodiments illustrated in FIGS. 10–13 were developed. As seen in FIG. 10, alternative embodiment 202 is mountable between the base of the carburetor 12 and the intake manifold 14 in the same manner as embodiment 20. Embodiment 202 includes the same base plate 60 and the same top plate 64 of embodiment 20. The modification is in the intermediate plate which is designated 204 and the valve element supported therein.

Figure 12:
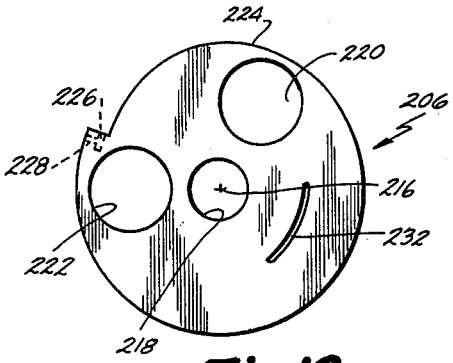
FIG. 12 is a top, plan view of the rotary valve element configured for use with a four-barrel carburetor.
Figure 11:
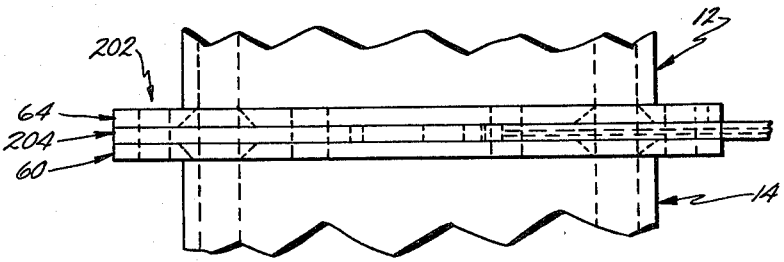
FIG. 11 is a top, plan view of the alternative embodiment of FIG. 10 with the top plate removed.

An intermediate plate 204 and a rotary valve element 206 for use with a four-barrel carburetor are illustrated in FIGS. 11 and 12. As shown therein, plate 204 is an elongated structure having a longitudinal axis generally designated 208. Plate 204 defines symmetrically located, paired apertures 210, 212. Apertures 210, 212 are coaxial with apertures 76, 78 of plates 60, 64 when the plates are stacked. Plate 204 further defines a circular valve element aperture 214 adapted to receive valve element 206.

As seen in FIGS. 11 and 12, valve element 206 is a circular, flat member having a central, rotary axis 216, a central mounting aperture 218 and a pair of angularly related through apertures 220, 222. Adjacent its outer periphery 224, element 206 is formed with a blind bore 226. A threaded bore 228 extends from peripheral surface 224 to bore 226. As seen in FIG. 11, cable actuator assembly 40 is secured to rotary valve element 206 by inserting cable 42 into bore 226 or it is fastened with a set screw 230. Cable 42 is, therefore, attached to rotary element 206 essentially along a tangential path. Valve element 206 is further formed with an arcuate, elongated slot 232. As seen in FIG. 11, when valve element 206 is positioned within aperture 214, a guide pin 234 extends from one of the plates 60, 64 and into slot 232. Also, a cylindrical plug 236 is positioned within slot or aperture 218 and is secured to one of the plates 60, 64. Valve element 206, therefore, is rotatable between first and second positions. Pin 234 acts as a stop at the extremes of each position. Further, plate 204 is formed with a tangential slot 238 through which cable 42 enters the intermediate plate.

When the device 202 is assembled and positioned between the carburetor 12 and intake manifold 14, apertures 220, 222 are alignable with the apertures 80, 82, respectively, of the base and top plates upon rotation of valve element 206. When in such a position, all of the cylinders will be "active". Upon movement of cable 42, valve element 206 will rotate about a central axis 216 and apertures 220, 222 will be brought out of alignment with apertures 82, 80 so that valve element 206 will block communication between these apertures on the top and base plates. This is the position shown in FIG. 11. As a result, the primary and secondary barrels of the carburetor feeding one bank of cylinders will be blocked and the cylinders will become "inactive".

Since the cable assembly 40 enters intermediate plate 204 along a lateral edge thereof and no portion of the valve extends from the assembly during actuation as in the prior embodiments, interference with other engine components is eliminated. The embodiment illustrated in FIGS. 10 and 11, therefore, is more universally adaptable to existing engine configurations. The device is easily fabricated from sheet metal employing conventional manufacturing processes. The same flathead fasteners and method of mounting device 20 between the carburetor and intake manifold are used with the embodiment designated 202.

Figure 13:
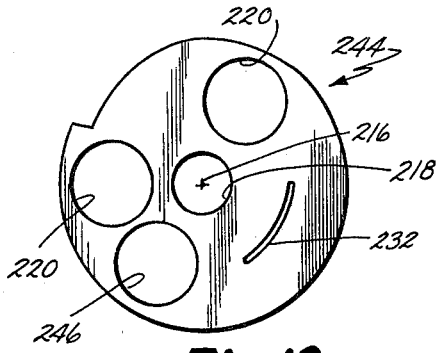
FIG. 13 is a top, plan view of a rotary valve element configured for use with a two-barrel carburetor.

When used with a two-barrel carburetor, the valve element 206 is removed and a valve element generally designated 244 and illustrated in FIG. 13 is substituted therefor. Element 244 is also generally circular in plan and includes a central axis 216 and central mounting aperture 218. Further, element 244 is formed with an arcuate stop slot 232. Element 244 is also formed with apertures 220, 222. The element, however, further includes a third aperture 246. Apertures 220, 222 and 246 are laid out on element 244 so that when the element is positioned in a "normal" operating position, apertures 80, 82 will communicate with and be open to or aligned with apertures 222, 220, respectively. As a result, the engine will operate in a normal mode with all cylinders active. When split engine operation is desired and one barrel of the carburetor is to be "disabled", element 244 is rotated. Apertures 220, 222 move out of and out of alignment with apertures 82, 80 of the top and base plates. Aperture 246 will be rotated into alignment with apertures 82 of the top and base plates. As a result, one barrel of the carburetor is placed in communication with the intake manifold through apertures 82 and the third aperture 246 in the valve element. The remaining barrel of the two-barrel carburetor is blocked by the valve element 244.

The rotary valve embodiment in accordance with the present invention is readily adaptable to two or four barrel operation by simple substitution of valve elements. When the plates of the rotary valve embodiment are stacked and assembled, the apertures are sealed from outside air since the cable housing 44 is disposed within the entrance slot 238 defined by the intermediate plate. Air leakage into the intake manifold when the device is mounted, therefore, is eliminated.

DIAGONAL SLIDE VALVE EMBODIMENT

Figure 14:
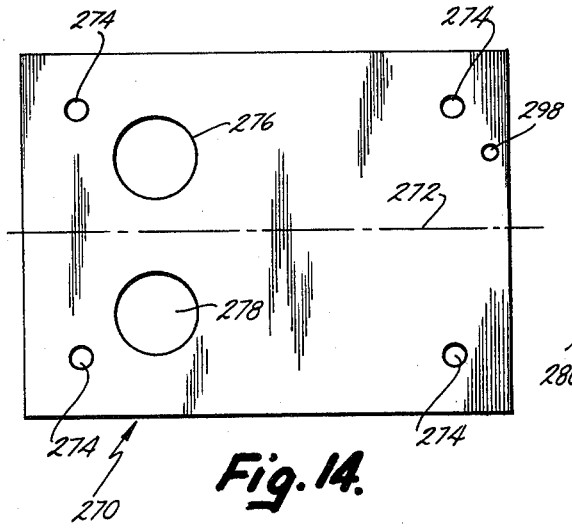
FIG. 14 is a top, plan view of a top and base plate of a still further embodiment.
Figure 15:
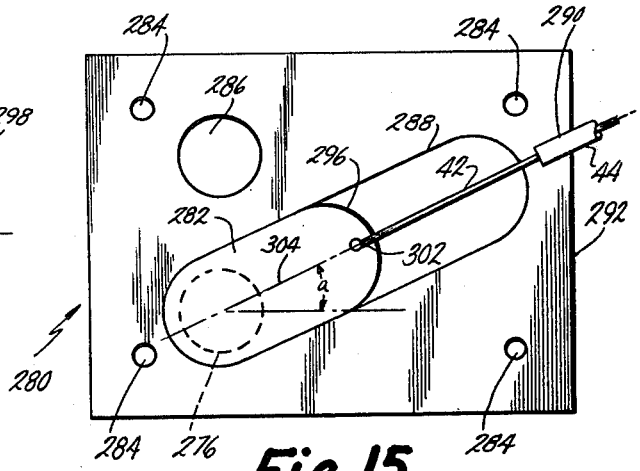
FIG. 15 is a top, plan view of the still further embodiment showing the intermediate plate and valve element.

A still further embodiment of the present invention is illustrated in FIGS. 14 and 15. As with the prior embodiments, the device of FIGS. 14 and 15 includes basically four elements, namely, a base and top plate 270, illustrated in FIG. 14, an intermediate plate 280 and a valve element 282 (FIG. 15). Plate 270 is an elongated, generally rectangular member which is symmetrical about its longitudinal axis 272. Plate 270 defines four spaced mounting apertures 274 and a pair of carburetor or barrel apertures 276, 278. Mounting holes or apertures 274 are arranged in the same pattern as the mounting holes for the carburetor of an Oldsmobile V-8 engine. As should be apparent, the bolts which secure the plates together in the embodiment of FIGS. 14 and 15 also mount the device between the carburetor and the intake manifold.

As seen in FIG. 15, intermediate plate 280 includes mounting holes or apertures 284 which are coaxial with apertures 274 when the plates are stacked. Intermediate plate 280 includes a single carburetor, barrel or through aperture 286 and an elongated, generally diagonally arranged valve element aperture 288. Intermediate plate 280 is formed with a bore 290 which opens into aperture 288 through a rear edge 292 adjacent the upper right-hand corner of the plate.

Valve element 282 is a generally elongated member having rounded leading and trailing edges 294, 296, respectively. Cable housing 44 seats within the enlarged portion of bore 290 and is held thereby a set screw threadably disposed within a threaded aperture 298 formed in the top plate 270. Cable 42 extends through bore 290 and into aperture 288 where it is connected with the slide valve 296 at a bore 302. Elongated aperture 288 has a longitudinal centerline 304 which is at an angle "a" of 30° with respect to the longitudinal axis of the intermediate plate.

When assembled, one or more top plates 270 would be positioned on top of intermediate plate 280 and the device installed between the carburetor and the intake manifold by suitable fasteners passing through the carburetor base and apertures 274, 284.

The embodiment of FIGS. 14 and 15 reduces the number of apertures formed in the sheet metal from that of the previous embodiments. Further, problems which can be experienced with interference on other components are obviated. The device may be positioned as shown in FIG. 15 or rotated through an angle of 180° so that the cable exits from a lower left-hand corner of the device. Forming the elongated valve element aperture 288 at an angle across the plate tends to "balance" the stresses formed in the plate material if the plate is punched from sheet material. This alleviates or eliminates warping problems which can result from machining or punching cold rolled steel sheets. Further, as with the embodiment illustrated in FIGS. 10 and 11, a more effective and efficient seal of the valve element within the device is created. The only opening for outside air into the valve element aperture 288 is through bore 290. Bore 290 is, however, effectively closed by the cable housing 44 disposed therein.

As with the previous embodiments, one or more top plates may have to be stacked in the assembly to insure clearance space for the throttle valve of conventional carburetors which may extend below the base of the carburetor. Also, with certain General Motors engine constructions, for example, the bolt hole mounting pattern for both four and two-barrel carburetors are identical to the configuration illustrated in FIGS. 14 and 15. As a result, this alternative device may be used with a four-barrel structure. When so used, the plates would be positioned beneath the carburetor so as to block off the secondary barrels permanently. If necessary to accommodate different bolt patterns, the adjustable mounting aperture arrangement illustrated in FIG. 9 and the countersunk aperture, flathead fastener mounting arrangement of the prior embodiments may be incorporated into the embodiment of FIGS. 14 and 15.

In view of the foregoing description, those of ordinary skill in the art will undoubtedly envision various modifications which would not depart from the inventive concepts disclosed herein. For example, valve element 110 could be modified to eliminate one of the arms 114. As a result, only the primary barrel feeding into intake manifold passage 32 would be blocked during split engine operation. Increased power could still be obtained without shifting the valve element out of the split engine mode of operation. The invention permits the advantages of split engine operation to be obtained at significantly reduced cost and without the need to modify any of the engine components. The structure may be used with a majority, if not all, of the presently existing multi-cylinder engines which employ a partitioned intake manifold. It is expressly intended, therefore, that the above description should be considered as only that of the preferred embodiment. The true spirit and scope of the present invention may be determined by reference to the appended claims.

The embodiments of the invention in which an exclusive property or privilege is claimed are defined as follows.

1. Apparatus for disabling selected cylinders of a multi-cylinder internal combustion engine of the type including an intake manifold defining a first passage leading to one-half of the cylinders and a second passage leading to the remaining cylinders, and a carburetor secured to said intake manifold for delivering an air/fuel mixture to each of said passages, said apparatus being interposable between said intake manifold and said carburetor and comprising:

a flat base plate defining at least a pair of spaced apertures;

a flat intermediate plate defining a valve element aperture;

at least one flat top plate defining another pair of spaced apertures which are coaxial with said apertures of said base plate, said plates being separate, thin members which are secured together in a stacked, contacting relationship;

a generally planar valve element movably disposed within said intermediate plate valve element aperture and movable between first and second positions, said valve element when in said first position blocking one of said apertures of said base plate and said top plate so that the air/fuel mixture can pass through only said other apertures of said base and top plates to one of said first and second passages thereby to disable selected cylinders, said valve element when in said second position permitting flow through said apertures of said base and top plates; and actuator means connected to said valve element for shifting said valve element between said first and second positions.

2. Apparatus as defined by claim 1 wherein said valve element is generally circular in plan view and said apparatus further includes means engaging said valve element for mounting said valve element for rotation about a central axis.

3. Apparatus as defined by claim 2 wherein said valve element defines at least two apertures, each positioned to be aligned with an aperture in said base and top plates.

4. Apparatus as defined by claim 3 further including mounting means for mounting said apparatus to the intake manifold and the carburetor, said mounting means comprising:

said base plate and said top plate each defining a plurality of countersunk mounting apertures; and a plurality of flathead fasteners, each disposed in one of said mounting apertures.

5. Apparatus as defined by claim 3 wherein said valve element further defines an arcuate slot and said apparatus further includes a stop pin extending from one of said plates and into said slot.

6. Apparatus as defined by claim 2 wherein said valve element is adapted to block off one set of primary and secondary barrels of a four-barrel carburetor, said valve element defining a pair of apertures positioned to permit flow of air/fuel mixture from said one set of barrels through a pair of apertures defined by said base and top plates, said element upon rotation to its first position blocking off said flow.

7. Apparatus as defined by claim 6 further including mounting means for mounting said apparatus to the intake manifold and the carburetor, said mounting means comprising:

said base plate and said top plate, each defining a plurality of countersunk mounting apertures; and a plurality of flathead fasteners, each disposed in one of said mounting apertures.

8. Apparatus as defined by claim 7 wherein said valve element further defines an arcuate slot and said apparatus further includes a stop pin extending from one of said plates and into said slot.

9. Apparatus as defined by claim 2 wherein said valve element is adapted to block off one barrel of a two-barrel carburetor when in said first position, said valve element defining:

first and second apertures which are aligned with said apertures of said base and top plates when said valve element is in said second position; and a third aperture positioned to be aligned with one of the carburetor barrels when said valve element is in said first position and said valve element blocks flow through the aperture of said top and base plates which are aligned with the other barrel.

10. Apparatus as defined by claim 1 wherein said intermediate plate defines a longitudinal axis, said valve element aperture extending along said axis and wherein said valve element is an elongated, flat member slidably disposed within said aperture for movement along the longitudinal axis between said first and second positions.

11. Apparatus as defined by claim 10 wherein said valve element is generally Y-shaped in plan and includes an elongated base leg and a pair of arms separated by a slot, said intermediate plate defining a guide portion extending into said slot.

12. Apparatus as defined by claim 10 further including mounting means for mounting said apparatus to the intake manifold and the carburetor, said mounting means comprising:

said base plate and said top plate, each defining a plurality of countersunk mounting apertures; and a plurality of flathead fasteners, each disposed in one of said mounting apertures.

13. Apparatus as defined by claim 11 further including mounting means for mounting said apparatus to the intake manifold and the carburetor, said mounting means comprising:

said base plate and said top plate, each defining a plurality of countersunk mounting apertures; and a plurality of flathead fasteners, each disposed in one of said mounting apertures.

14. Apparatus for disabling selected cylinders of a multi-cylinder internal combustion engine of the type including an intake manifold defining a first passage leading to one-half of the cylinders and a second passage leading to the remaining cylinders, and a carburetor secured to said intake manifold for delivering an air/fuel mixture to each of said passages, said apparatus being interposable between said intake manifold and said carburetor and comprising:

a base plate defining at least a pair of spaced apertures;

an intermediate plate defining a valve element aperture;

at least one top plate defining another pair of spaced apertures which are coaxial with said apertures of said base plate, said plates being secured together in a stacked relationship;

a generally planar valve element movably disposed within said intermediate plate valve element aperture and movable between first and second positions, said valve element when in said first position blocking one of said apertures of said base plate and said top plate so that the air/fuel mixture can pass through only said other apertures of said base and top plates to one of said first and second passages thereby to disable selected cylinders, said valve element when in said second position permitting flow through said apertures of said base and top plates; and actuator means connected to said valve element for shifting said valve element between said first and second positions, said intermediate plate defining a longitudinal axis and said valve element aperture extending at an acute angle with respect to said axis, said intermediate plate defining a bore opening into said valve element aperture and adapted to receive said actuator means.

15. Apparatus as defined by claim 14 wherein said valve element is an elongated flat member slidably disposed within said valve element aperture.

16. A device mountable between the base of a multi-barrel carburetor and an intake manifold of an internal combustion engine for blocking communication of at least one barrel of the carburetor with the manifold to disable selected cylinders of the engine, said device comprising:

a plurality of stacked and superimposed, thin, flat plates including a top plate and a bottom plate, said plates defining at least a pair of spaced barrel apertures opening through the top and bottom plates and one of said plates intermediate said top and bottom plates defining a valve element aperture;

a valve element slidably disposed within said valve element aperture and sandwiched between said top and bottom ones of said plates; and a cable actuator means operatively connected to said valve element for shifting said element from a first position blocking at least one of said barrel apertures to a second position opening said one of said barrel apertures.

17. A device as defined by claim 16 wherein said plates define a plurality of superimposed mounting apertures, at least some of which have positioned therein a rotatably adjustable circular member having an eccentrically located hole.

18. A device as defined by claim 17 wherein said plates are elongated, flat members, each defining a longitudinal axis and said valve element aperture extends at an acute angle with respect to said axis, said valve element aperture including closed front and rear ends and said intermediate plate defining a bore opening into said valve element aperture at said rear end, said cable actuator being disposed within said bore.

19. A device as defined by claim 17 wherein said valve element aperture is circular in plan and said valve element is a circular, flat member disposed within said valve element aperture and defining a pair of angularly related valve element apertures alignable with said barrel apertures.

20. A device as defined by claim 18 wherein said plates define a plurality of superimposed mounting apertures, at least some of which have positioned therein a rotatably adjustable circular member having an eccentrically located hole.

21. A device as defined by claim 19 wherein said plates define a plurality of superimposed mounting apertures, at least some of which have positioned therein a rotatably adjustable circular member having an eccentrically located hole.

* * * * *